US011661263B2

(12) United States Patent
Learn

(10) Patent No.: US 11,661,263 B2
(45) Date of Patent: May 30, 2023

(54) UNITARY BLANK FOR FORMING A CUP SLEEVE

(71) Applicant: PACTIV LLC, Lake Forest, IL (US)

(72) Inventor: Angela E. Learn, Gilbertsville, PA (US)

(73) Assignee: PACTIV LLC, Lake Forest, IL (US)

( * ) Notice: Subject to any disclaimer, the term of this patent is extended or adjusted under 35 U.S.C. 154(b) by 212 days.

(21) Appl. No.: 17/122,472

(22) Filed: Dec. 15, 2020

(65) Prior Publication Data

US 2022/0185572 A1 Jun. 16, 2022

(51) Int. Cl.

*B65D 81/38* (2006.01)
*B31B 50/81* (2017.01)
*B65D 5/02* (2006.01)

(52) U.S. Cl.

CPC ..... *B65D 81/3876* (2013.01); *B31B 50/81* (2017.08); *B65D 5/029* (2013.01)

(58) Field of Classification Search

CPC ..... B65D 5/029; B65D 81/3876; B65D 3/22; B65D 25/36; B31B 50/81; B31B 2105/00; A47G 23/0216

USPC ..... 229/403, 4.5; 220/739, 738, 737, 903; 215/395

See application file for complete search history.

(56) References Cited

U.S. PATENT DOCUMENTS 5,209,367 A 5/1993 Van Musscher et al.
5,857,615 A 1/1999 Rose
6,032,826 A * 3/2000 Libit ..... B65D 81/3876 220/738
6,152,363 A 11/2000 Rule, Jr.
6,224,954 B1 * 5/2001 Mitchell ..... B65D 81/3874 428/161
6,286,754 B1 9/2001 Stier et al.
7,458,504 B2 * 12/2008 Robertson ..... B65D 81/3874 220/62.12
8,523,008 B2 9/2013 Kim et al.
10,327,574 B2 6/2019 Yang et al.
2010/0147937 A1 6/2010 Reid et al.
2010/0200647 A1 * 8/2010 Tedford ..... B65D 81/3876 229/4.5

FOREIGN PATENT DOCUMENTS

WO WO 02/087994 A1 11/2002

* cited by examiner

*Primary Examiner* — King M Chu
(74) *Attorney, Agent, or Firm* — Baker Botts L.L.P.

(57) ABSTRACT

Unitary blank for forming a cup sleeve is provided having a central body portion, a first side body portion, and a second side body portion, a central flap extending from the central body portion, a first flap extending from the first side body portion, the first flap including a first tab, and a second flap extending from the second side body portion, the second flap including a second tab. In addition, at least a selected surface area of the blank has a pattern of raised features. Raised pattern areas of inner fold-over flaps can overlay corresponding raised pattern areas of sleeve outer body panels thereby increasing a size or volume of air gap pockets created between inner flaps and outer body panels. A multi-layer cup sleeve and a method for forming a cup sleeve are also provided.

21 Claims, 13 Drawing Sheets

UNITARY BLANK FOR FORMING A CUP SLEEVE

BACKGROUND

Field of the Disclosed Subject Matter

The present disclosed subject matter relates to a cup sleeve. Particularly, the present disclosed subject matter is directed to a thermally insulating sleeve for a cup containing a hot or cold beverage. For example, when the sleeve is used around a cup containing a hot beverage, the sleeve provides insulation from the heat.

Description of Related Art

A variety of hot or cold beverages, such as coffee and tea, are often contained in paper or plastic cups. Such cups may not be good insulators from heat or cold, and thus, such cups may not be comfortable to hold.

Various attempts have been made to address this problem by providing sleeves for cups containing hot beverages, such as cup sleeves made of fluted and corrugated fiberboard. As an alternative, paperboard cup sleeves would be less expensive than fluted corrugated options, but standard single-ply paperboard does not provide thermally insulating characteristic as efficient or effective as fluted corrugated options.

Various two-ply sleeve configurations made of paperboard have been developed, but with limited success due to complicated construction techniques or limited thermal insulation improvement. As such, there remains a need for a thermally-insulating cup sleeve made of paperboard but with enhanced thermally-insulating characteristics and simplified construction.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a unitary blank for forming a cup sleeve including a central body portion, a first side body portion, and a second side body portion. The central body portion has a first side edge, a second side edge, and a central top edge. The first side edge is at least partially defined by a first side fold line, the second side edge is at least partially defined by a second side fold line, and the central top edge is at least partially defined by a central top fold line. The first side body portion extends from the central body portion at the first side fold line, and the first side body portion has a first side top edge at least partially defined by a first side top fold line. The second side body portion extends from the central body portion at the second side fold line, and the second side body portion has a top edge at least partially defined by a second side top fold line. A central flap extends from the central body portion at the central top fold line. A first flap extends from the first side body portion at the first side top fold line. A second flap extends from the second side body portion at the second side top fold line.

Furthermore, the unitary blank includes at least a selected surface area of the blank having a pattern of raised features. The central flap, the first flap, and the second flap are each configured to be folded about the central top fold line, the first side top fold line and the second side top fold line, respectively, to form a multi-layer intermediate article with the pattern of raised features defining a plurality of air pockets. The multi-layer intermediate article is curled to form a multi-layer cup sleeve.

The first flap can include a first tab extending from a first tab edge of the first flap, and the second flap can include a first tab extending from a second tab edge of the second flap. The unitary blank can include a first-tab-body-cut-out defined proximate the first side fold line of the central body portion and a second-tab-body-cut-out defined proximate the second side fold line of the central body portion. The first tab can be configured to extend through the first-tab-body-cut-out and the second tab can be configured to extend through the second-tab-body-cut-out.

The unitary blank can include a first-tab-flap-cut-out defined proximate a first-tab-flap-cut-out-edge of the central flap and a second-tab-flap-cut-out defined proximate a second-tab-flap-cut-out-edge of the central flap. The first-tab-flap-cut-out can be configured to engage with the first tab and the second-tab-flap-cut-out can be configured to engage with the second tab.

The unitary blank can include a third flap extending from the first side body portion at a third flap edge. The unitary blank can further include a third tab extending from a third tab edge of the second side body portion. The unitary blank can further include a third-tab-body-cut-out defined proximate the third flap edge of the first side body portion. The third tab can be configured to extend through the third-tab-body-cut-out. The unitary blank can further include a third-tab-first-flap-cut-out defined proximate a third-tab-first-flap-cut-out-edge of the first flap. The third-tab-first-flap-cut-out can be configured to engage with the third tab. The unitary blank can further include a third-tab-second-flap-cut-out defined proximate a third-tab-second-flap-cut-out-edge of the second flap. The third-tab-second-flap-cut-out can be configured to engage with the third tab.

In accordance with another aspect of the disclosed subject matter, the unitary blank can further include a first middle flap extending between the first-tab-flap-cut-out-edge of the central flap and the first tab edge of the first flap, and a second middle flap extending between the second-tab-flap-cut-out-edge of the central flap and the second tab edge of the second flap, wherein the first-tab-flap-cut-out-edge is defined proximate a first-tab-flap-cut-out-edge-fold-line and the second-tab-flap-cut-out-edge is defined proximate a second-tab-flap-cut-out-edge-fold-line. In this manner the central flap, the first flap, the second flap, the first middle flap, and the second middle flap each can be folded about the central top fold line, the first side top fold line and the second side top fold line, respectively, partially forming a multi-layer intermediate article with the pattern of raised features defining a plurality of air pockets. The raised pattern areas of inner flaps can overlay corresponding raised pattern areas of sleeve outer body panels thereby increasing the volume of air pockets created between inner flaps and outer body panels.

The first flap, central flap, and second flap can be joined to the first side body portion, central side body portion, and the second side body portion, such as by glue or thermal adhesive or the like. Furthermore, with the intermediate article curled to define a frustoconical shape, the first side body portion can be joined to the second side body portion, or if provided, the third flap can be joined to the second side body portion, such as by glue or thermal adhesive or the like.

The first flap, central flap, and second flap can each further have a top edge defining a top edge radius. The first side body portion, central body portion, and second side body portion can each further have a bottom edge defining a bottom edge radius. The first flap can be folded along the first side top fold line at a first angle, and further wherein the second flap is folded along the second side top fold line at a second angle. The pattern can have a thickness in a range from 0.012 inches to 0.018 inches.

The disclosed subject matter also includes a multi-layer cup sleeve including a central side body portion, a first side body portion, and a second side body portion. The central body portion has a first side edge, a second side edge, and a central top edge. The first side edge is at least partially defined by a first side fold line, the second side edge is at least partially defined by a second side fold line, and the central top edge is at least partially defined by a central top fold line. The first side body portion extends from the central body portion at the first side fold line, and the first side body portion has a first side top edge at least partially defined by a first side top fold line. The second side body portion extends from the central body portion at the second side fold line, and the second side body portion has a top edge at least partially defined by a second side top fold line. The central body portion includes a central flap moveable between an open position and a closed position, the central top fold line to fold the central flap in the closed position, which is substantially parallel to the central body portion. The first side body portion includes a first flap moveable between an open position and a closed position, the first side top fold line to fold the first flap in the closed position, which is substantially parallel to the first side body portion. The second side body portion includes a second flap moveable between an open position and a closed position, the second side top fold line to fold the second flap in the closed position, which is substantially parallel to the second side body portion. The multi-layer cup sleeve also includes at least a selected surface area of the sleeve having a pattern of raised features. The central flap, the first flap, and the second flap of the sleeve are each in the closed position with the pattern of raised features defining a plurality of air pockets between the body portions and flaps, and the various portions of the sleeve curled define a frustoconical shape.

The disclosed subject matter also includes a method of forming a cup sleeve including providing a blank including a central body portion, a first side body portion, and a second side body portion. The central body portion has a first side edge, a second side edge, and a central top edge. The first side edge is at least partially defined by a first side fold line, the second side edge is at least partially defined by a second side fold line, and the central top edge is at least partially defined by a central top fold line. The first side body portion extends from the central body portion at the first side fold line, and the first side body portion has a first side top edge at least partially defined by a first side top fold line. The second side body portion extends from the central body portion at the second side fold line, and the second side body portion has a top edge at least partially defined by a second side top fold line. The central body portion includes a central flap extending from the central body portion at the central top fold line. The first side body portion includes a first flap extending from the first side body portion at the first side top fold line. The second side body portion includes a second flap extending from the second side body portion at the second side top fold line. The blank also includes at least a selected surface area of the blank having a pattern of raised features. The method of forming a cup sleeve further includes folding the central flap, the first flap, and the second flap about the central top fold line, the first side top fold line and the second side top fold line, respectively, to form a multi-layer intermediate article with the pattern of raised features defining a plurality of air pockets. The method of forming a cup sleeve further includes curling the multi-layer intermediate article to define a frustoconical shape.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein can be used for a cup sleeve or a unitary blank forming a cup sleeve. The disclosed subject matter is particularly suited for forming a unitary blank or cup sleeve for a cup containing a beverage, wherein the blank or sleeve provides thermally-insulating characteristics when the cup contains a hot or cold beverage.

In accordance with the disclosed subject matter, a blank is provided including a unitary blank for forming a cup sleeve including a central body portion, a first side body portion, and a second side body portion. The central body portion has a first side edge, a second side edge, and a central top edge. The first side edge is at least partially defined by a first side fold line, the second side edge is at least partially defined by a second side fold line, and the central top edge is at least partially defined by a central top fold line. The first side body portion extends from the central body portion at the first side fold line, and the first side body portion has a first side top edge at least partially defined by a first side top fold line. The second side body portion extends from the central body portion at the second side fold line, and the second side body portion has a top edge at least partially defined by a second side top fold line. The central body portion includes a central flap extending from the central body portion at the central top fold line. The first side body portion includes a first flap extending from the first side body portion at the first side top fold line. The second side body portion includes a second flap extending from the second side body portion at the second side top fold line. Furthermore, the unitary blank includes at least a selected surface area of the blank having a pattern of raised features. The central flap, the first flap, and the second flap are each configured to be folded about the central top fold line, the first side top fold line and the second side top fold line, respectively, to form a multi-layer intermediate article with the pattern of raised features defining a plurality of air pockets.

Figure 1:
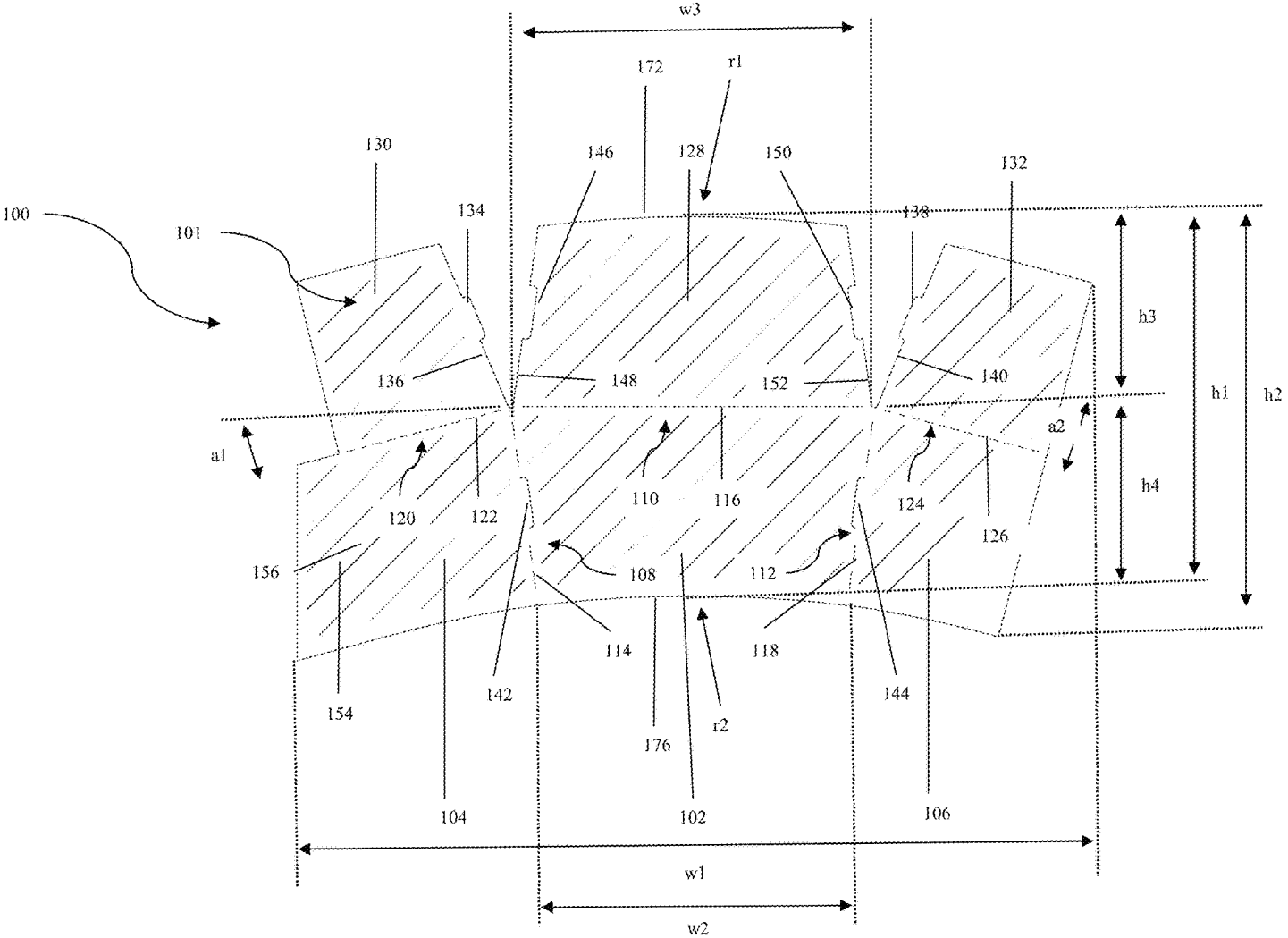
FIG. 1 is a plan view of an exemplary unitary blank for forming a cup sleeve in accordance with the disclosed subject matter.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, an exemplary unitary blank forming a cup sleeve in accordance with the disclosed subject matter is shown in FIG. 1. Additionally, for purpose of understanding, reference is made in conjunction to the sleeve 800 of FIG. 8, which is formed by the blank 100 of FIG. 1. For purpose of illustration, and not limitation, reference will made herein to a unitary blank for forming a cup sleeve intended to contain a cup holding beverages, however, the disclosed unitary blank can be used for forming a sleeve intended to contain a cup (or other similar implement) holding a variety of substances that can be hot (e.g., soup, French fries) or cold (e.g., ice cream, flavored ices). Additionally, as used herein, the terms "front," "rear," "side," "top," and "bottom" are used for the purpose of illustration only, and not limitation. That is, it is recognized that the terms "front," "rear," "side," "top," and "bottom" are interchangeable and are merely used herein as a point of reference.

As embodied herein for purpose of illustration and not limitation, FIG. 1 illustrates a unitary blank for forming a cup sleeve. As shown in FIG. 1, the unitary blank 100, which can be used to form the sleeve 800 of FIG. 8, includes a central body portion 102, a first side body portion 104, and a second side body portion 106. The central body portion 102 has a first side edge 108, a central top edge 110, and a second side edge 112. The first side edge 108 is at least partially defined by a first side fold line 114. The central top edge 110 is at least partially defined by a central top fold line 116. The second side edge 112 is at least partially defined by a second side fold line 118. The first side body portion 104 extends from the central body portion 102 at the first side fold line 114, and the first side body portion 104 has a first side top edge 120 at least partially defined by a first side top fold line 122. The second side body portion 106 extends from the central body portion 102 at the second side fold line 118, and the second side body portion 106 has a top edge 124 at least partially defined by a second side top fold line 126. The central body portion 102 includes a central flap 128 extending from the central body portion 102 at the central top fold line 118. The first side body portion 104 includes a first flap 130 extending from the first side body portion 104 at the first side top fold line 122. The second side body portion 106 includes a second flap 132 extending from the second side body portion 106 at the second side top fold line 126.

Figure 8:
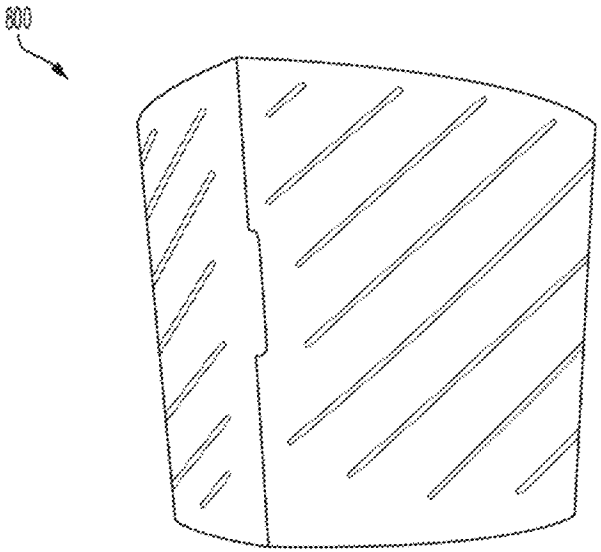
FIG. 8 is a side view of an exemplary cup sleeve in accordance with the disclosed subject matter.

To form the sleeve of the disclosed subject matter, the method includes forming a multi-layer intermediate article using the blank as disclosed by folding the central flap 128, the first flap 130 and the second flap 132 about the central top fold line 118, the first side top fold line 122 and the second side top fold line 126, respectively. A multi-layer cup sleeve 800, as shown in FIG. 8, can be formed by curling the multi-layer intermediate article into a frustoconical shape. The first side body portion and the second side body portion can then be joined together using conventional techniques, such as by glue or thermal adhesive or the like.

As embodied herein, the unitary blank 100 can further include a first tab 134 extending from a first tab edge 136 of the first flap 130 and a second tab 138 extending from a second tab edge 140 of the second flap 132. The unitary blank 100 can further include a first-tab-body-cut-out 142 defined proximate the first side fold line 114 of the central body portion 102 and a second-tab-body-cut-out 144 defined proximate the second side fold line 118 of the central body portion 102. When the multi-layer cup sleeve 800 is formed, the first tab 134 can extend through the first-tab-body-cut-out 142 and the second tab 138 can extend through the second-tab-body-cut-out 144. When tabs 134, 138 extend though cut-outs 142, 144, tabs 134, 138 can provide additional distance and insulation from a cup held in the sleeve. The first and second tab-body-cut-outs 142, 144 and tabs 134, 138 can have any suitable shapes and dimensions for forming the multi-layer cup sleeve 800. Although first and second tab-body-cut-outs 142, 144 and tabs 134, 138 are illustrated, any suitable number of cut outs and tabs can be used.

The unitary blank 100 can further include a first-tab-flap-cut-out 146 defined proximate a first-tab-flap-cut-out-edge 148 of the central flap 128 and a second-tab-flap-cut-out 150 defined proximate a second-tab-flap-cut-out-edge 152 of the central flap 128. The first-tab-flap-cut-out 146 can engage with the first tab 134 and the second-tab-flap-cut-out 150 can engage with the second tab 138. First and second tab-flap-cut-outs 146, 150 can have any suitable shapes and dimensions for forming the multi-layer cup sleeve 800. Although only first and second tab-flap-cut-outs 146, 150 are illustrated, any suitable number can be used.

Figure 2:
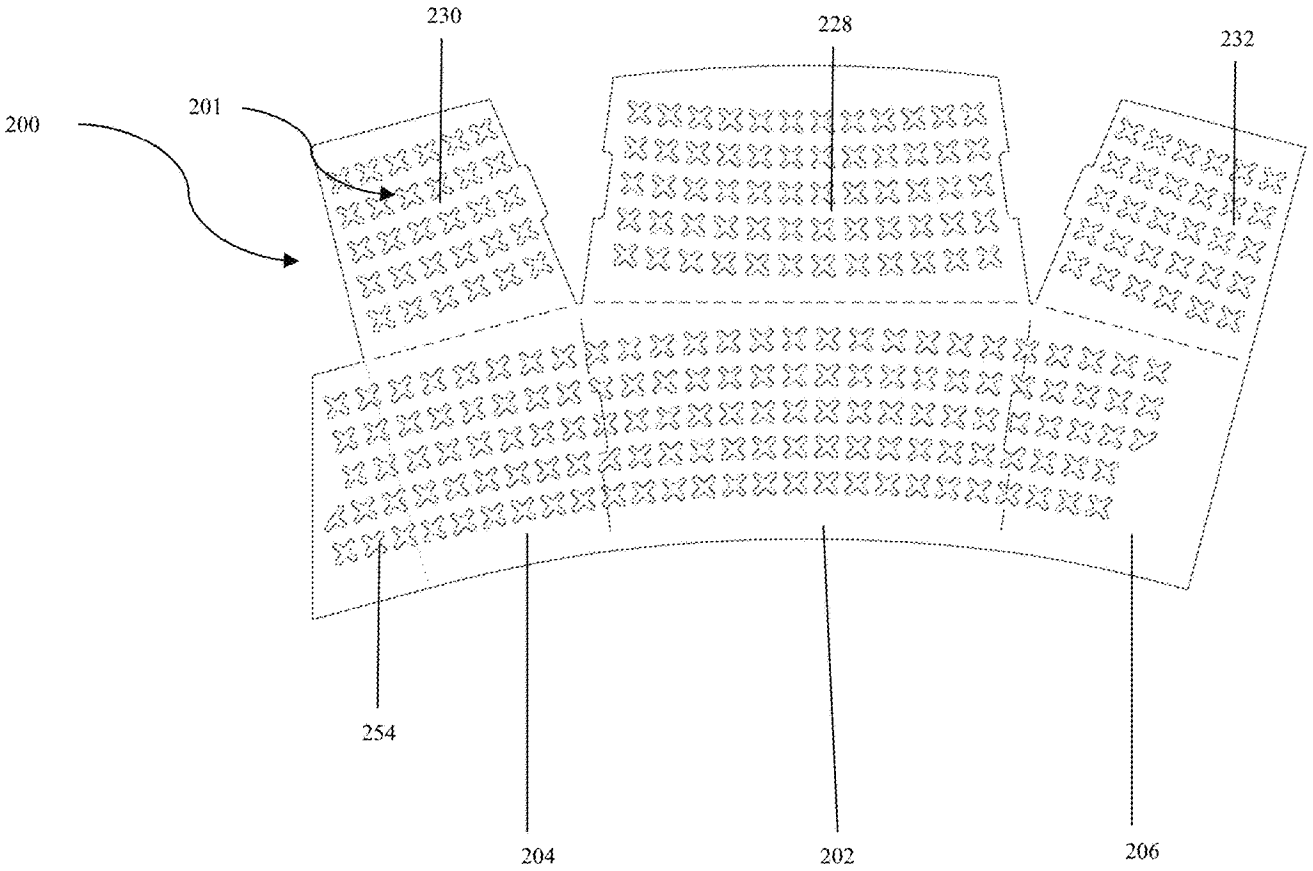
FIG. 2 is a plan view of an exemplary unitary blank including a pattern of raised features having an "x" configuration in accordance with the disclosed subject matter.
Figure 3:
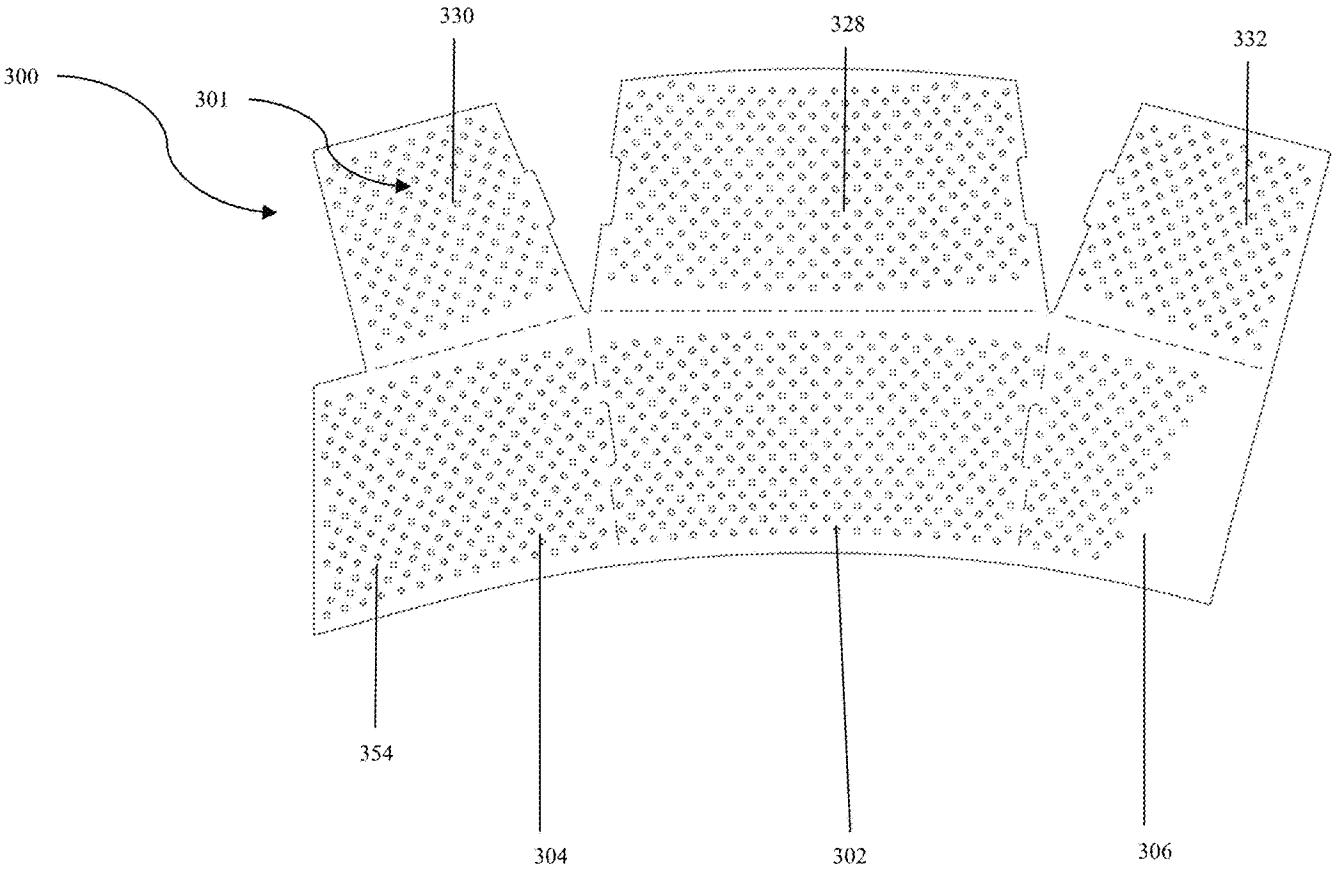
FIG. 3 is a plan view of an exemplary unitary blank including a pattern of raised features having an "o" configuration in accordance with the disclosed subject matter.

Additionally or alternatively, the unitary blank 100 can include a third flap 154 extending from the first side body portion 104 at a third flap edge 156. The third flap 154 can be joined to the second side body portion 106 when the multi-layer intermediate article is curled to form the multi-layer cup sleeve 800. For example, the third flap 154 can be joined to the second side body portion 106 using conventional techniques, such as by glue or thermal adhesive or the like. FIGS. 2 and 3 can have one or more features as included in blank 100, for example, central flap 228, 328, first flap 230, 330, second flap 232, 332, central body portion 202, 302, first side body portion 204, 304, second side body portion 206, 306, and third flap 254, 354.

Figure 4A:
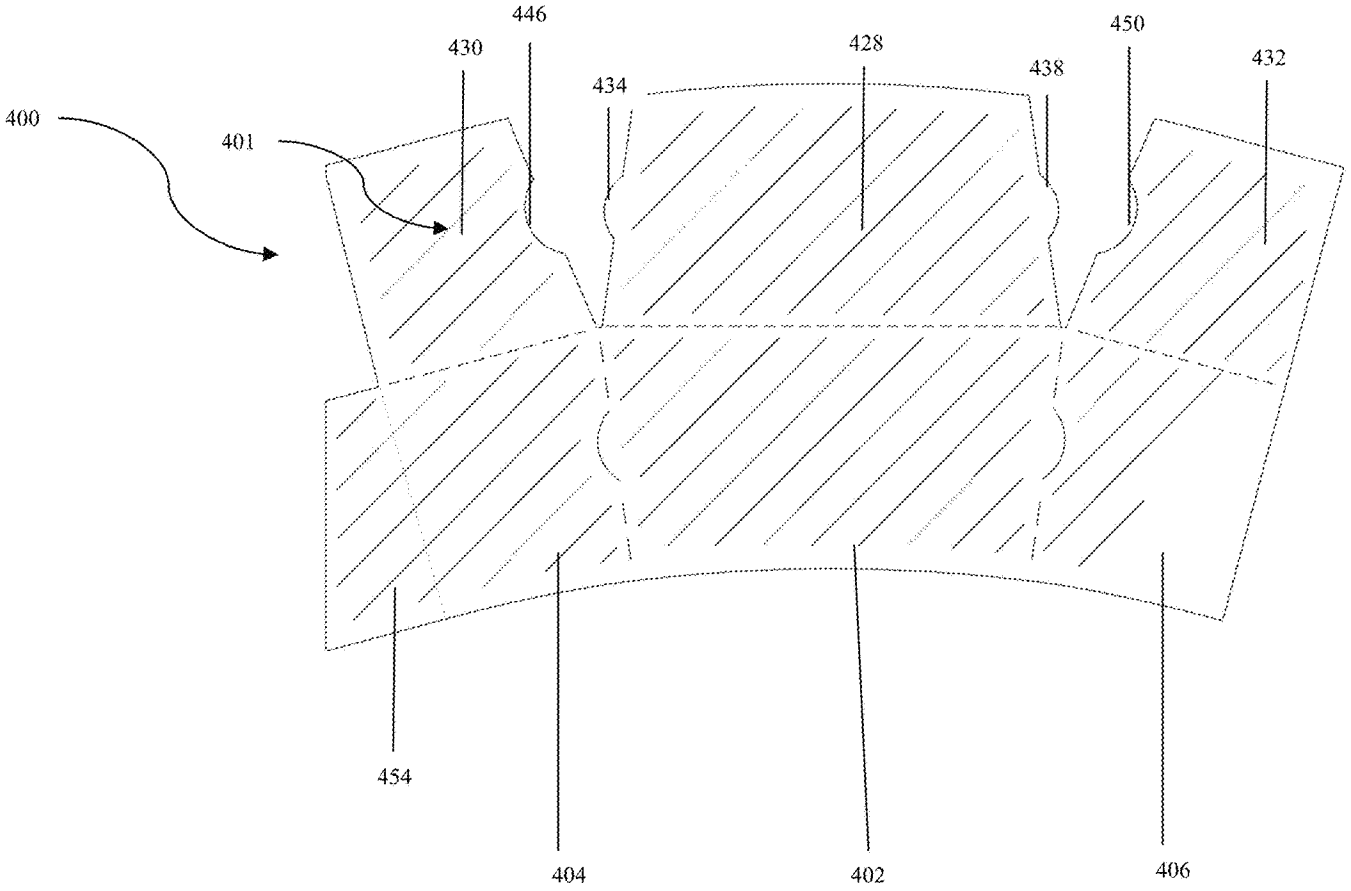
FIG. 4A is a plan view of an exemplary unitary blank including tabs with c-shaped configurations in accordance with the disclosed subject matter.
Figure 4B:
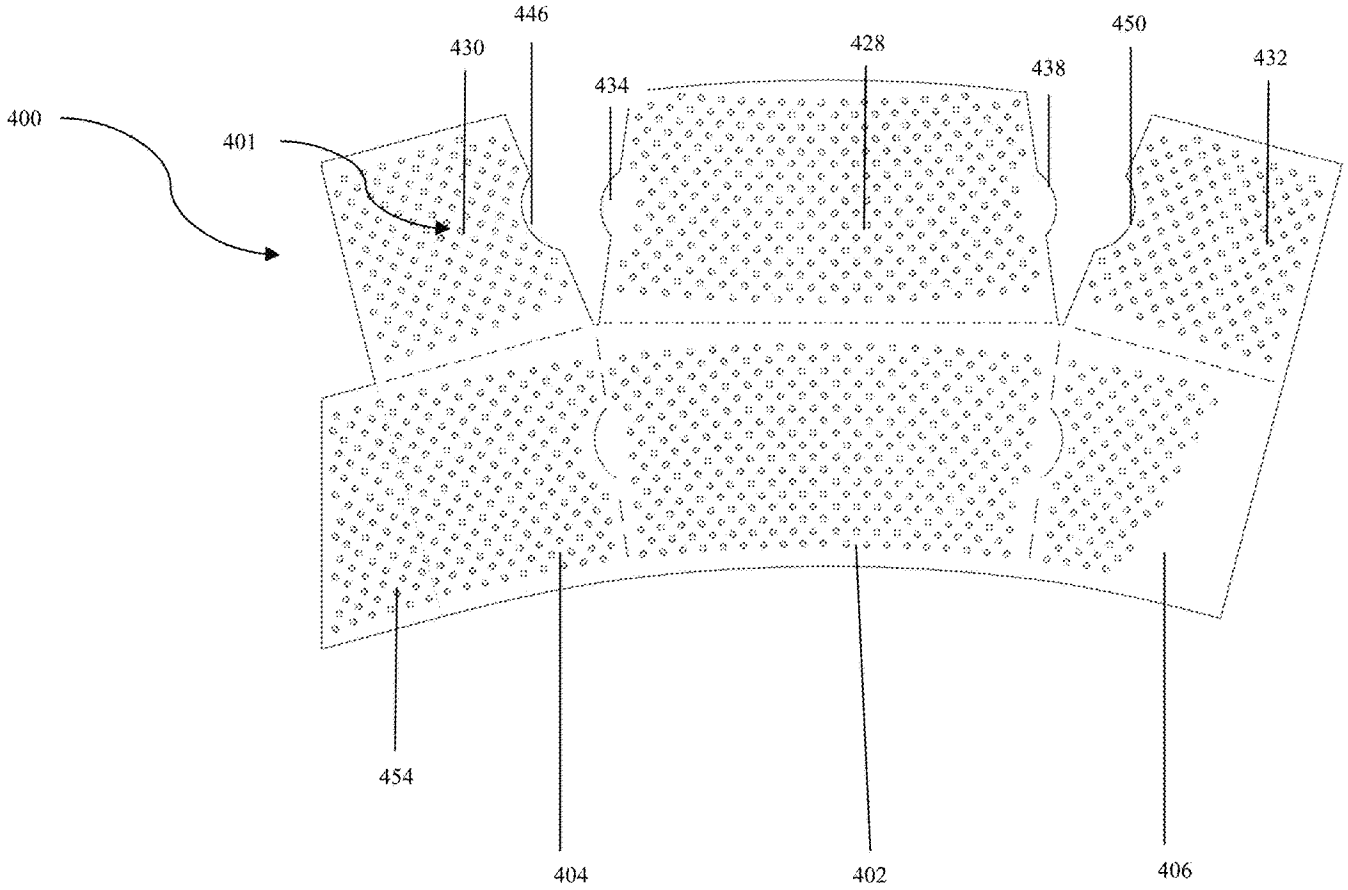
FIG. 4B is a plan view of an exemplary unitary blank including tabs with c-shaped configurations and a pattern of raised features having an "o" configuration in accordance with the disclosed subject matter.

For purpose of illustration and not limitation, the tabs 134, 138, first and second tab-flap-cut-outs 146, 150, and first and second tab-body-cut-outs 142, 144 can be of any suitable shape, including but not limited to u-shaped and radius cut-outs, and any other male cut-out shape that can protrude through a corresponding female slot. As shown in FIGS. 4A and 4B, for purpose of illustration and not limitation, the blank 400 can include tabs 434, 438 located on the central flap 428 and the first and second tab-flap-cut-outs 446, 450 can be located on the first and second flaps 430, 432. As shown in FIG. 1, the cut-outs 142, 144 can face towards the central body portion 102. Alternatively, as shown in FIGS. 4A and 4B, the cut-outs 442, 444 can face away from the central body portion 402. FIGS. 4A and 4B can also have one or more features as included in blank 100, for example, central body portion 402, first side body portion 404, and second side body portion 406, and third flap 454.

For purpose of illustration and not limitation, the unitary blank 100 can have a width "w1" of about 10 to 12 inches. The height of the unitary blank 100 can have a height "h1" of about 5.0 to 7.0 inches and a height "h2" of about 6.0 to 8.0 inches. The central body portion 102 can have a height "h3" of about 2.25 to 4.0 inches. The central flap can have a height "h4" of about 2.25 to 4.0 inches. The central body portion 102 can have a width "w2" of about 4.0 to 5.0 and a width "w3" of about 4.75 to 6.25 inches.

A selected surface area of the unitary blank 100 can include a pattern of raised features 101. The pattern 101 preferably has a thickness dimension in a range from 0.006 to 0.018 inches. The pattern 101 on the flaps 128, 130, 132 can be designed to with respect to the pattern 101 on body portions 102, 104, 106, such that the patterns engage when flaps 128, 130, 132 are folded against body portions 102, 104, 106, thus creating a plurality of air pockets in the multi-layer intermediate article. When the pattern of raised features 101 on flaps 128, 130, 132 are engaged with the corresponding raised pattern 101 of body portions 102, 104, 106, the size, e.g., volume, of air pockets created between flaps 128, 130, 132 and body portions 102, 104, 106 can be increased. For example and without limitation, a single ply air pocket of 0.010 inches would approximately double to 0.020 inches when inner flaps and outer body panels are combined. Increased air pockets can be formed by allowing central flap 128 and inner flaps 130 and 132 to move freely when sleeve is curled. Sleeve side body panels 104 and 106 can be joined by adhesive connection of their overlap panel portions whose combined folded dimension is greater than dimension of panel 102. Likewise, flaps 128, 130, 134 can be joined to body portions 102, 104, 106 using conventional techniques, such as by glue or thermal adhesive or the like. The pattern 101 can be on both a top surface of the blank 100 and a bottom surface of the blank 100. The pattern can be of any suitable shape and dimensions, including but not limited to stripes, crosses, or dots. For example, as shown in FIGS. 1, 4A, 5, and 6A, the blank 100, 400, 500, 600 can include patterns of raised features 101, 401, 501, 601 having a striped configuration. As shown in FIG. 2, the blank 200 can include a pattern of raised features 201 having an "x" configuration. As shown in FIGS. 3, 4B, and 6B, the blanks 300, 400, 600 can include patterns of raised features 301, 401, 601 having an "o" configuration.

Figure 5:
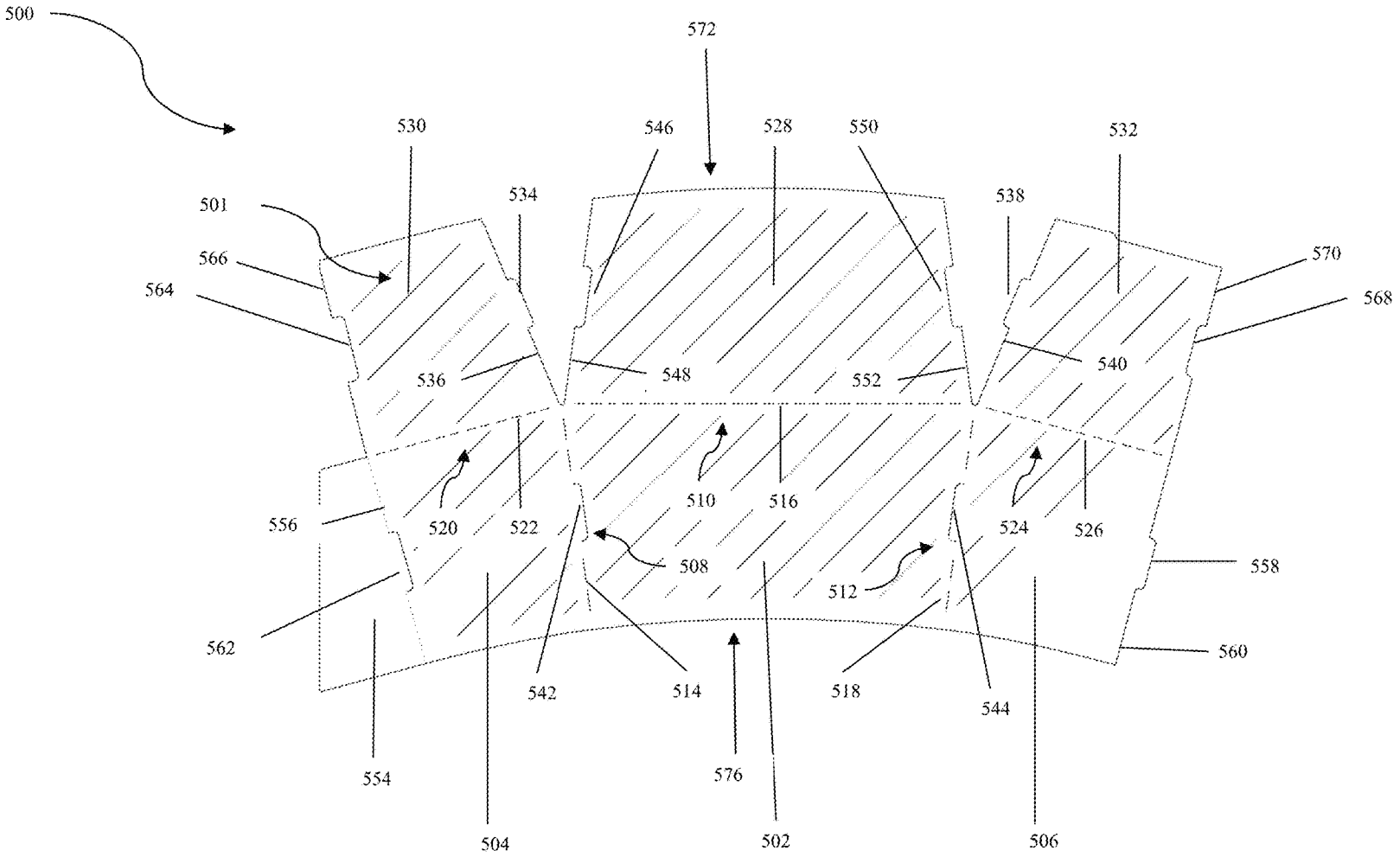
FIG. 5 is a plan view of an exemplary unitary blank including a third tab in accordance with the disclosed subject matter.

As further embodied herein, and as shown in FIG. 5 for purpose of illustration and not limitation, the unitary blank 500 can include a third tab 558 extending from a third tab edge 560 of the second side body portion 506. The unitary blank 500 can further include a third-tab-body-cut-out 562 defined proximate the third flap edge 556 of the first side body portion 504. The third tab 558 can extend through the third-tab-body-cut-out 562. The unitary blank 500 can further include a third-tab-first-flap-cut-out 564 defined proximate a third-tab-first-flap-cut-out-edge 566 of the first flap 530. The third-tab-first-flap-cut-out 564 can engage with the third tab 558. The unitary blank 500 can further include a third-tab-second-flap-cut-out 568 defined proximate a third-tab-second-flap-cut-out-edge 570 of the second flap 532. The third-tab-second-flap-cut-out 568 can engage with the third tab 558. The tab-flap-cut-outs 546, 550, 564, 568, tab-body-cut-outs 542, 544, 562 and tabs 542, 544, 558 can have any suitable shapes and dimensions for forming the multi-layer cup sleeve 800, and any suitable number of cut-outs and tabs can be used.

Figure 6A:
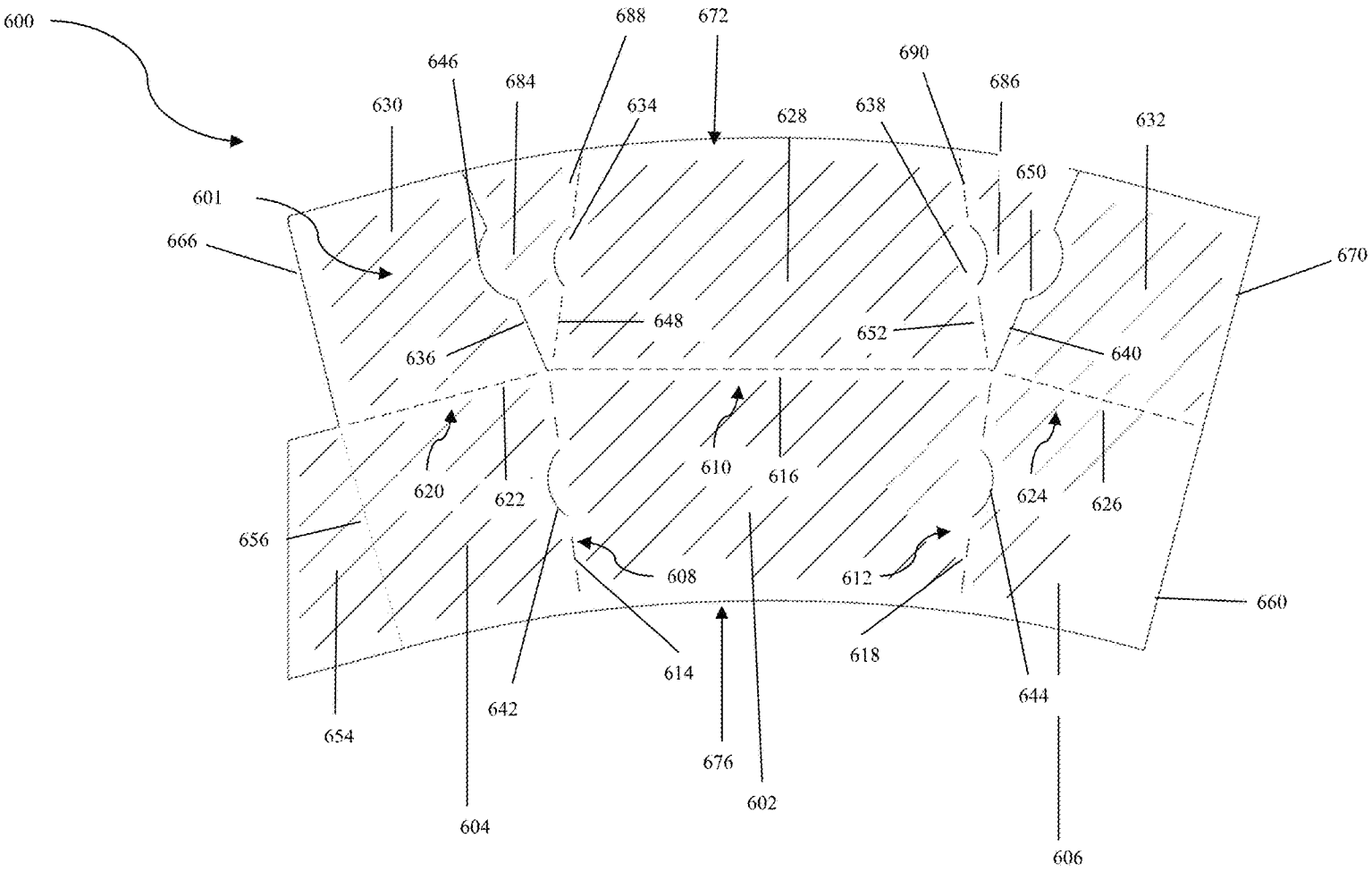
FIG. 6A is a plan view of an exemplary unitary blank for forming a cup sleeve including additional flaps in accordance with the disclosed subject matter.
Figure 6B:
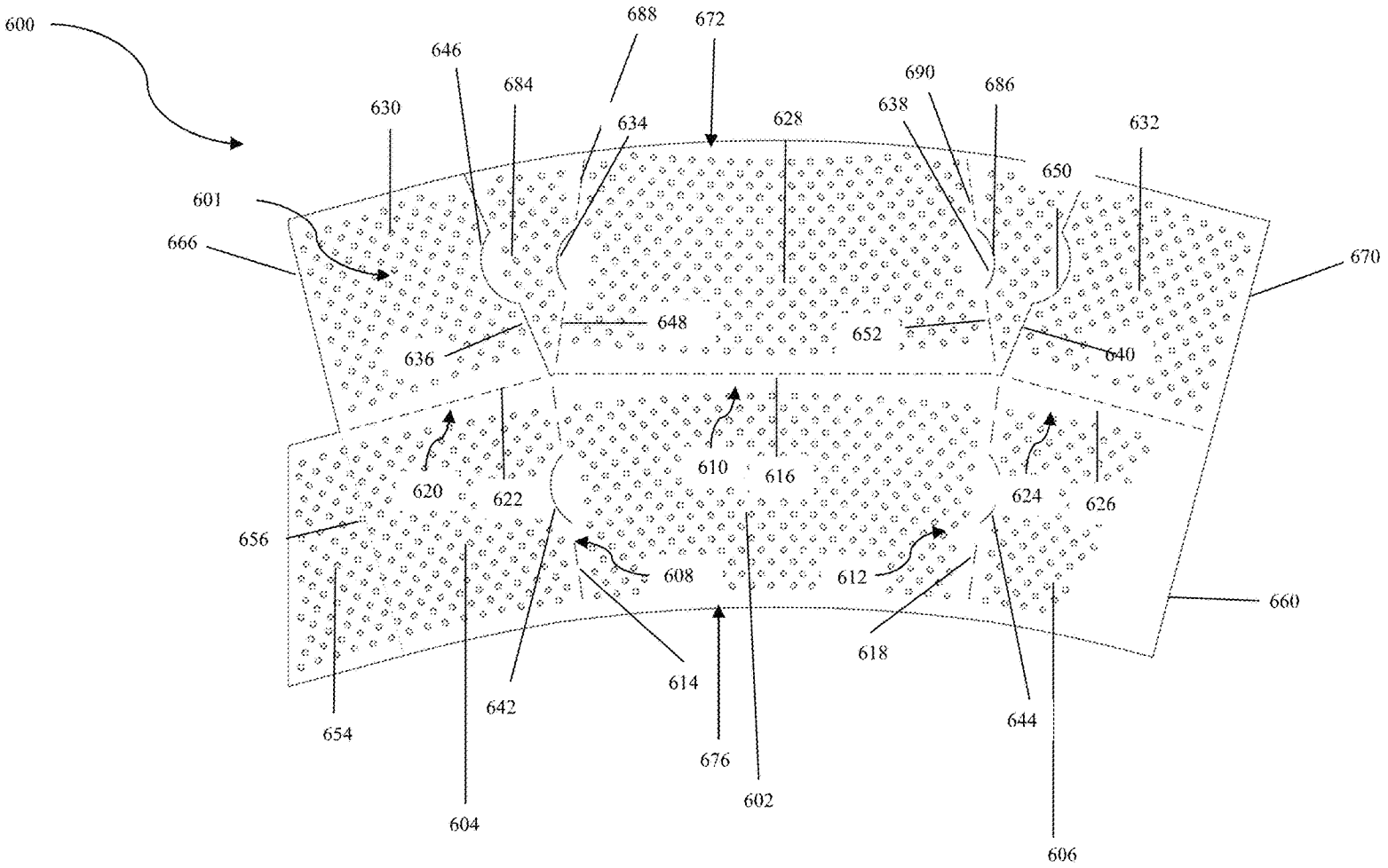
FIG. 6B is a plan view of an exemplary unitary blank for forming a cup sleeve including additional flaps and a pattern of raised features having an "o" configuration in accordance with the disclosed subject matter.
Figure 7A:
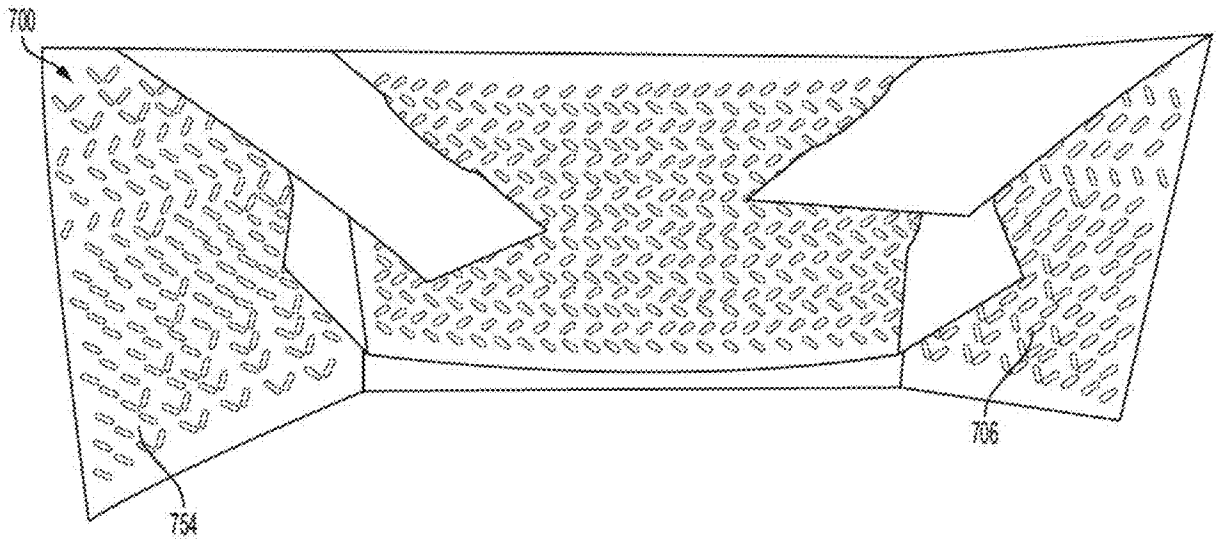
FIG. 7A is a side view of an exemplary multi-layer intermediate article in accordance with the disclosed subject matter.
Figure 7B:
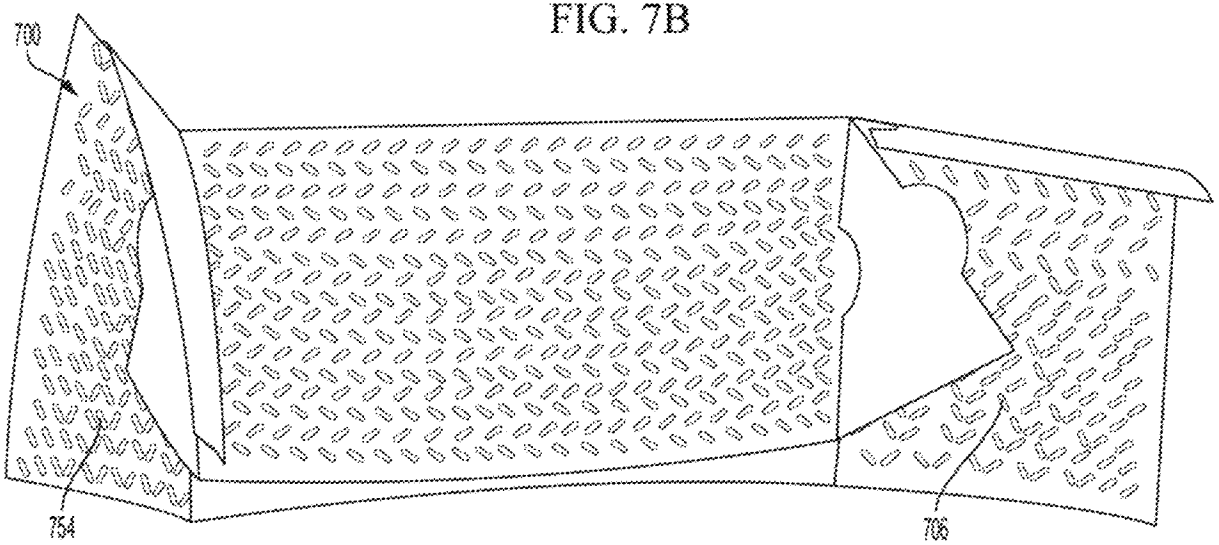
FIG. 7B is a side view of an exemplary multi-layer intermediate article in accordance with the disclosed subject matter.
Figure 7C:
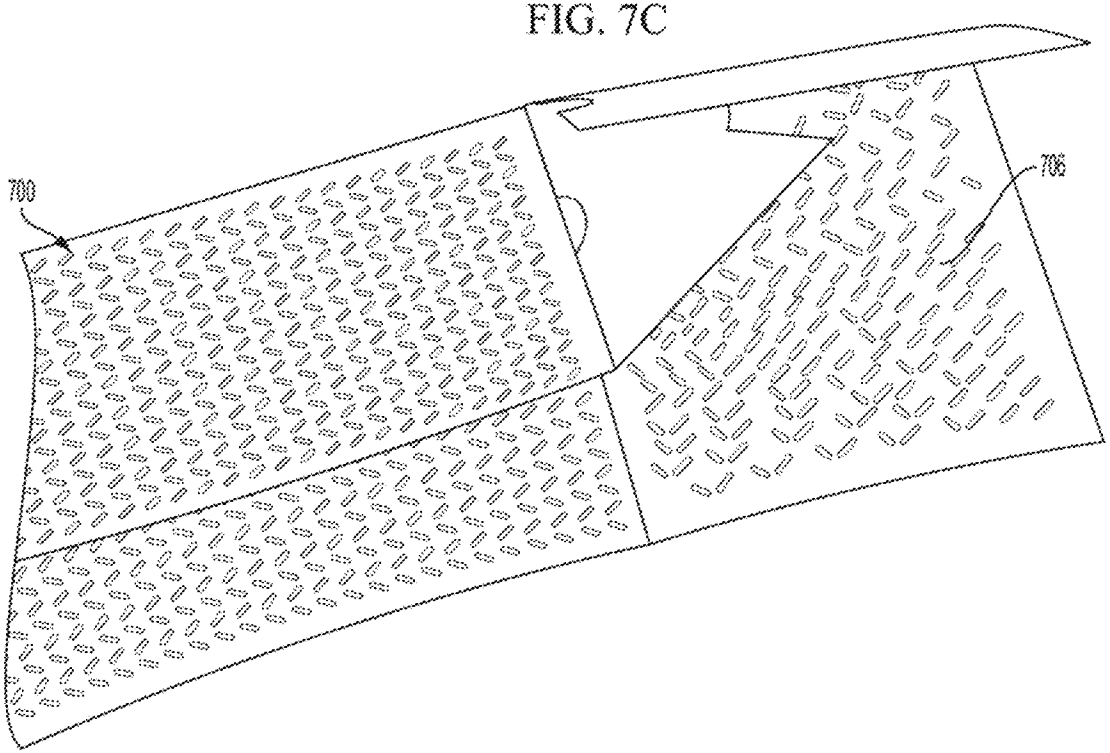
FIG. 7C is a perspective view of a portion of an exemplary multi-layer intermediate article in accordance with the disclosed subject matter.
Figure 9:
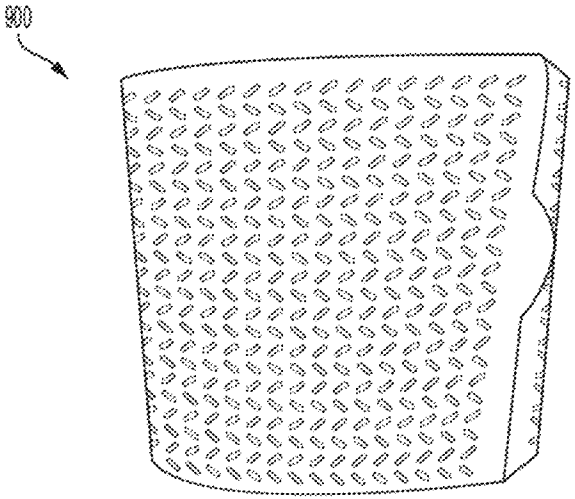
FIG. 9 is a side view of an exemplary cup sleeve having additional flaps in accordance with the disclosed subject matter.

In accordance with the disclosed subject matter, and as shown in FIGS. 6A and 6B, the unitary blank 600 can include a first middle flap 684 and a second middle flap 686. The first middle flap 684 can extend from the first tab edge 648 of the central flap 628 toward the first-tab-flap-cut-out-edge 636 of the first flap 630. The second middle flap 686 can extend from the second tab edge 652 of the central flap 628 toward the second-tab-flap-cut-out-edge 640 of the second flap 632. The first tab edge 648 is at least partially defined by a first-tab-edge-fold-line 688. The second tab edge 652 is at least partially defined by a second-tab-edge-fold-line 690. When the central flap 628, the first flap 630 and the second flap 632 are folded about the central top fold line 616, the first side top fold line 622 and the second side top fold line 626, respectively, the first middle flap 684 and the second middle flap 686 are also folded with the central flap 628, the first flap 630 and the second flap 632, partially forming a multi-layer intermediate article 700, as shown in FIGS. 7A-7C, with the pattern of raised features 601 defining a plurality of air pockets. As shown in FIGS. 6A and 6B, when the pattern of raised features 601 on inner flaps 628, 630, 632 are engaged with the corresponding raised pattern 601 of body portions 602, 604, 606, the size or volume of air pockets created between inner flaps 628, 630, 632 and body portions 602, 604, 606 can be increased. For example, and without limitation, a 0.010 in. single-ply air pocket would double to 0.020 in when the raised pattern 601 of inner flaps 628, 630, 632 engage the raised pattern 601 of body portions 602, 604, 606, respectively. Additionally or alternatively, unitary blank 600 can further include a third tab 658 extending from a third tab edge 660 of the second side body portion 606. Alternatively, the first middle flap 684 and the second middle flap 686 can extend from the first flap 630 and the second flap 632, respectively, and toward the central flap 628. The first side body portion 604 can be joined to the second side body portion 606 and the multi-layer intermediate article 700, as shown in FIGS. 7A-7C, can be curled to form a multi-layer cup sleeve 900, as shown in FIG. 9. The tab-flap-cut-outs 646, 650, tab-body-cut-outs 642, 644 and tabs 634, 638, 658 can have any suitable shapes and dimensions for forming the multi-layer cup sleeve 900, and any suitable number of cut-outs and tabs can be used. Alternatively, the third flap 654 can be joined to the second side body portion 606 and the multi-layer intermediate article 700, as shown in FIGS. 7A-7C, can be curled to form multi-layer cup sleeve 900, as shown in FIG. 9. For example and without limitation, as shown in FIGS. 7A-7C, the third flap 754 can be joined to the second side body portion 706 and the multi-layer intermediate article 700 can be curled to form multi-layer cup sleeve 900, as shown in FIG. 9. In FIG. 9, the multi-layer cup sleeve 900 is formed with three layers in approximately half of the total sleeve surface.

The first flap 630 and second flap 632 can be adhesively joined to the first side body portion 604 and the second side body portion 606. Additionally or alternatively, the central flap 628 can be adhesively joined to the central body portion 602, and the third flap 654 can be adhesively joined to the second side body portion 606. The adhesive can be made of any suitable material, including but not limited to hot melt adhesive, water based glue, solvent based glue, radiation curable glue, and/or suitable foams. The adhesive can be coated on some or all of the sides of flaps 628, 630, 632 that fold against body portions 602, 604, 606, such when the flap 628, 630, 632 are folded about the fold lines 616, 622, 626, to form a multi-layer intermediate article 700, the flaps 628, 630, 632 are adhesively joined to the body portions 602, 604, 606.

As shown in FIG. 1, the first flap 130, central flap 128, and second flap 132, and middle flaps if provided, can each further have a top edge 172 defining a top edge radius r1. The first side body portion 104, central body portion 102, and second side body portion 106 can each further have a bottom edge 176 defining a bottom edge radius r2. The top edge radius r1 and the bottom edge radius r2 preferably have a radius preferably in the range of 16 to 17 degrees.

The first flap 130 can be folded along the first side top fold line 122 at a first angle "a1", and further wherein the second flap 132 is folded along the second side top fold line 126 at a second angle "a2". The first angle "a1" preferably has an angle of around 15 degrees from a horizontal axis defined at the central top fold line 116. The second angle "a2" preferably has an angle of around 105 degrees from a horizontal axis defined at the central top fold line 116.

The containers disclosed herein are preferably disposable, but it is contemplated that they can be reused at a future time. Also, the blanks and sleeves described herein can be manufactured from any suitable material, including but not limited to paper, paper laminated on at least one side, multiple-walled paper, paperboard, resin, plastic and other polymers, suitable composite materials, and/or suitable foams.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A unitary blank for forming a cup sleeve, comprising:

a central body portion having a first side edge, a second side edge, and a central top edge, the first side edge at least partially defined by a first side fold line, the second side edge at least partially defined by a second side fold line, and the central top edge at least partially defined by a central top fold line;

a first side body portion extending from the central body portion at the first side fold line, the first side body portion having a first side top edge at least partially defined by a first side top fold line;

a second side body portion extending from the central body portion at the second side fold line, the second side body portion having a top edge at least partially defined by a second side top fold line;

a central flap extending from the central body portion at the central top fold line;

a first flap extending from the first side body portion at the first side top fold line;

a second flap extending from the second side body portion at the second side top fold line;

a first tab extending from a first tab edge of the first flap;

a second tab extending from a second tab edge of the second flap;

wherein the central flap, the first flap, and the second flap each is configured to be folded about the central top fold line, the first side top fold line and the second side top fold line, respectively, to form a multi-layer intermediate article; and wherein the multi-layer intermediate article is curled to form a multi-layer cup sleeve.

2. The blank of claim 1, further comprising a first-tab-body-cut-out defined proximate the first side fold line of the central body portion and a second-tab-body-cut-out defined proximate the second side fold line of the central body portion, the first tab configured to extend through the first-tab-body-cut-out and the second tab configured to extend through the second-tab-body-cut-out.

3. The blank of claim 2, further comprising a first-tab-flap-cut-out defined proximate a first-tab-flap-cut-out-edge of the central flap and a second-tab-flap-cut-out defined proximate a second-tab-flap-cut-out-edge of the central flap, wherein the first-tab-flap-cut-out is configured to engage with the first tab and the second-tab-flap-cut-out is configured to engage with the second tab.

4. The blank of claim 1, further comprising a third flap extending from the first side body portion at a third flap edge.

5. The blank of claim 4, further comprising a third tab extending from a third tab edge of the second side body portion.

6. The blank of claim 5, further comprising a third-tab-body-cut-out defined proximate the third flap edge of the first side body portion, the third tab configured to extend through the third-tab-body-cut-out.

7. The blank of claim 6, further comprising a third-tab-first-flap-cut-out defined proximate a third-tab-first-flap-cut-out-edge of the first flap, the third-tab-first-flap-cut-out configured to engage with the third tab.

8. The blank of claim 7, further comprising a third-tab-second-flap-cut-out, defined proximate a third-tab-second-flap-cut-out-edge of the second flap, the third-tab-second-flap-cut-out configured to engage with the third tab.

9. The blank of claim 8, further comprising a first middle flap extending from the first-tab-flap-cut-out-edge of the central flap toward the first tab edge of the first flap, and a second middle flap extending from the second-tab-flap-cut-out-edge of the central flap toward the second tab edge of the second flap, wherein the first-tab-flap-cut-out-edge is defined proximate a first-tab-flap-cut-out-edge-fold-line and the second-tab-flap-cut-out-edge is defined proximate a second-tab-flap-cut-out-edge-fold-line.

10. The blank of claim 9, wherein the central flap, the first flap, the second flap, the first middle flap, and the second middle flap each is configured to be folded about the central top fold line, the first side top fold line and the second side top fold line, respectively, partially forming a three-layer intermediate article with the pattern of raised features defining a plurality of air pockets.

11. The blank of claim 10, wherein the raised pattern areas of inner flaps overlay corresponding raised pattern areas of sleeve outer body panels thereby increasing a volume of the air pockets created between inner flaps and outer body panels.

12. The blank of claim 1, wherein the first flap, central flap, and second flap are bonded to the first side body portion, central side body portion, and the second side body portion by an adhesive.

13. The blank of claim 4, wherein the third flap is bonded to the second side body portion by an adhesive.

14. The blank of claim 1, wherein the first flap, central flap, and second flap each further has a top edge defining a top edge radius.

15. The blank of claim 1, wherein the first side body portion, central body portion, and second side body portion each further has a bottom edge defining a bottom edge radius.

16. The blank of claim 1, wherein the first flap is folded along the first side top fold line at a first angle, and further wherein the second flap is folded along the second side top fold line at a second angle.

17. The blank of claim 1, wherein the pattern has a thickness in a range from 0.012 inches to 0.018 inches.

18. A multi-layer cup sleeve comprising:

a central body portion having a first side edge, a second side edge, and a central top edge, the first side edge at least partially defined by a first side fold line, the second side edge at least partially defined by a second side fold line, and the central top edge at least partially defined by a central top fold line;

a first side body portion extending from the central body portion at the first side fold line, the first side body portion having a first side top edge at least partially defined by a first side top fold line; and a second side body portion extending from the central body portion at the second side fold line, the second side body portion having a top edge at least partially defined by a second side top fold line;

a central flap extending from the central body portion moveable between an open position and a closed position by folding the central flap along the central top fold line to fold the central flap in the closed position, the closed position substantially parallel to the central body portion;

a first flap extending from the first body portion moveable between an open position and a closed position by folding the first flap along the first side top fold line to fold the first flap in the closed position, the closed position substantially parallel to the first side body portion;

a second flap extending from the second body portion moveable between an open position and a closed position by folding the second flap along the second side top fold line to fold the second flap in the closed position, the closed position substantially parallel to the second side body portion;

a first tab extending from a first tab edge of the first flap;

a second tab extending from a second tab edge of the second flap;

wherein the central flap, the first flap, and the second flap are each in the closed position; and the central body portion, the first side body portion and the second side body portion are curled to define a frustoconical shape.

19. A method of forming a cup sleeve comprising:

providing a blank comprising:

a central body portion having a first side edge, a second side edge, and a central top edge, the first side edge at least partially defined by a first side fold line, the second side edge at least partially defined by a second side fold line, and the central top edge at least partially defined by a central top fold line;

a first side body portion extending from the central body portion at the first side fold line, the first side body portion having a first side top edge at least partially defined by a first side top fold line;

a second side body portion extending from the central body portion at the second side fold line, the second side body portion having a top edge at least partially defined by a second side top fold line;

a central flap extending from the central body portion at the central top fold line;

a first flap extending from the first side body portion at the first side top fold line;

a second flap extending from the second side body portion at the second side top fold line;

a first tab extending from a first tab edge of the first flap;

a second tab extending from a second tab edge of the second flap;

folding the central flap, the first flap, and the second flap about the central top fold line, the first side top fold line and the second side top fold line, respectively, to form a multi-layer intermediate article; and curling the multi-layer intermediate article to define a frustoconical shape.

20. The blank of claim 1, wherein one or more of the first side top fold line, central top fold line, and the second side top fold line are curved or non-linear.

21. The blank of claim 1, further comprising a pattern of raised features disposed on at least a selected surface area of the blank, wherein the multi-layer intermediate article is formed with the pattern of raised features defining a plurality of air pockets.

* * * * *